US007446287B2

(12) United States Patent
Tominaga et al.

(10) Patent No.: US 7,446,287 B2
(45) Date of Patent: Nov. 4, 2008

(54) INDUCTION HEATING COOKER WITH BUOYANCY REDUCING PLATE

(75) Inventors: Hiroshi Tominaga, Hyogo (JP); Kenji Watanabe, Nara (JP); Chika Mae, Kanagawa (JP)

(73) Assignee: Matsushita Electrical Industrial Co., Ltd., Osaka (JP)

( * ) Notice: Subject to any disclaimer, the term of this patent is extended or adjusted under 35 U.S.C. 154(b) by 0 days.

(21) Appl. No.: 11/660,647

(22) PCT Filed: Apr. 18, 2006

(86) PCT No.: PCT/JP2006/308097

§ 371 (c)(1),
(2), (4) Date: Feb. 21, 2007

(87) PCT Pub. No.: WO2006/126345

PCT Pub. Date: Nov. 30, 2006

(65) Prior Publication Data

US 2007/0278216 A1 Dec. 6, 2007

(30) Foreign Application Priority Data

May 27, 2005 (JP) ..... 2005-155263

(51) Int. Cl.
*H05B 6/12* (2006.01)
*H05B 6/06* (2006.01)

(52) U.S. Cl. ..... 219/626; 219/627; 219/665; 219/650; 219/667

(58) Field of Classification Search ..... 219/620–627, 219/647, 649, 650, 665–667, 518; 99/451, 99/DIG. 14

See application file for complete search history.

(56) References Cited

U.S. PATENT DOCUMENTS

| | | | | |
|---|---|---|---|---|
| 3,775,577 | A * | 11/1973 | Peters, Jr. | 219/626 |
| 3,973,105 | A * | 8/1976 | Tsumori | 219/626 |
| 2003/0178416 | A1 | 9/2003 | Fujii et al. | |
| 2004/0245244 | A1 | 12/2004 | Hirota et al. | |

FOREIGN PATENT DOCUMENTS

| | | |
|---|---|---|
| JP | 3-184295 | 8/1991 |
| JP | 2003-282228 | 10/2003 |
| JP | 2003-347028 | 12/2003 |
| JP | 2004-139802 | 5/2004 |
| JP | 2004-171929 | 6/2004 |

* cited by examiner

*Primary Examiner*—Philip H Leung
(74) *Attorney, Agent, or Firm*—Wenderoth, Lind & Ponack, L.L.P.

(57) ABSTRACT

An induction heating cooker has a top plate, a heating coil, an inverter circuit, a pot type discriminator, a non-magnetic-metal buoyancy reducing plate having a high electrical conductivity, an infrared sensor, a temperature calculator, and a controller. The pot type discriminator judges whether a pot is made of a non-magnetic metal material having a high electrical conductivity, or a magnetic metal material or a non-magnetic metal lower in electrical conductivity than aluminum. The temperature calculator calculates the temperature of the pot from an output from the infrared sensor that detects infrared radiation from the pot. The controller controls an output from the inverter circuit according to a calculated temperature by the temperature calculator, and, when the pot is judged to be made of a non-magnetic metal material by the pot type discriminator, nullifies temperature detection made by the temperature calculator.

18 Claims, 5 Drawing Sheets

FIG. 5 - PRIOR ART
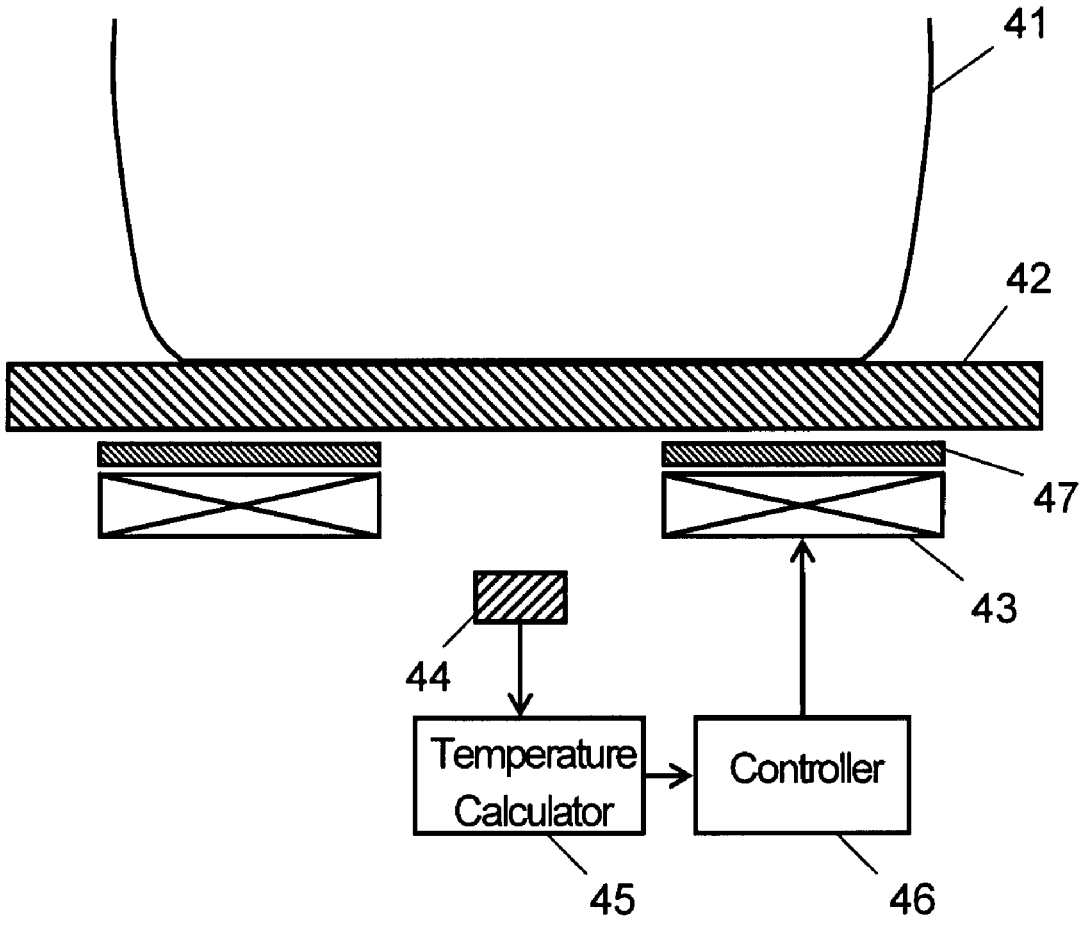

INDUCTION HEATING COOKER WITH BUOYANCY REDUCING PLATE

This application is a U.S. national phase application of PCT International Application PCT/JP2006/308097, filed Apr. 18, 2006.

TECHNICAL FIELD

The present invention relates to an induction heating cooker which includes an infrared sensor for measuring temperature.

BACKGROUND ART

FIG. 5 is a cross sectional view of a conventional induction heating cooker showing the concept of its structure. Cooking pot 41 as a load of heating is placed on top plate 42. Heating coil (hereinafter referred to as coil) 43 heats cooking pot 41. Infrared sensor 44 detects infrared radiation of cooking pot 41, and temperature calculator 45 calculates a temperature of cooking pot 41 based on an output from infrared sensor 44. Controller 46 controls current supply to coil 43 in accordance with an output from temperature calculator 45. In the above-configured induction heating cooker, the temperature of cooking pot 41 is detected directly by means of an infrared radiation coming from the bottom of cooking pot 41; thus it can make use of quick-responding temperature detection. The induction heating cooker of the above-described structure is disclosed in, for example, Japanese Patent Unexamined Publication No. H3-184295.

However, an induction heating cooker of the above-described structure designed to be compatible with a low resistance cooking pot made of aluminum, copper or the like material having a low magnetic permeability and a high electrical conductivity comparable to or higher than that of aluminum demonstrates a poor cooking performance. This is because it requires buoyancy reducing plate 47 made of aluminum or the like non-magnetic-metal having a high electrical conductivity to be disposed above coil 43, in order to reduce buoyancy caused during induction heating between coil 43 and pot 41.

In this case, the temperature of buoyancy reducing plate 47 sometimes goes as high as approximately 300-400° C. by self heat generation due to magnetic flux of coil 43. Accordingly, the infrared radiation from buoyancy reducing plate 47 will have an energy several tens of times that from the bottom of pot 41, whose temperature is 100-200° C. When the infrared radiation from buoyancy reducing plate 47 partly reaches to infrared sensor 44 directly or indirectly after being reflected by top plate 42, temperature calculator 45 delivers incorrect information of temperature detection to controller 46 after receiving signal from infrared sensor 44. Upon receiving the temperature information, controller 46 lowers the output to coil 43. This invites an insufficiency in the heating power, and deteriorates the cooking performance.

SUMMARY OF THE INVENTION

An induction heating cooker in the present invention implements a quick-responding temperature control with an infrared sensor when heating a pot made of a magnetic metal material (iron, cast iron, magnetic stainless steel, etc.) or a metal material lower in electrical conductivity than aluminum, such as a non-magnetic stainless steel. Meanwhile, when heating a non-magnetic pot having a high electrical conductivity that is comparable to or higher than that of aluminum (hereinafter referred to as the high electrical conductivity), the induction heating cooker reduces the buoyancy effecting to the pot by making use of a buoyancy reducing plate, and at the same time lowers the influence of an infrared radiation from the buoyancy reducing plate. Thus it alleviates the insufficiency of cooking power to be caused due to the temperature control by the infrared sensor, and improves the cooking performance. The induction heating cooker in the present invention includes a top plate configured to place a cooking pot thereon, a heating coil disposed underneath the top plate, an inverter circuit, a pot type discriminator, a buoyancy reducing plate made of a non-magnetic-material having the high electrical conductivity, an infrared sensor, a temperature calculator, and a controller. The inverter circuit supplies a high frequency current to the heating coil. The pot type discriminator judges whether the pot is made of a non-magnetic meal material having the high electrical conductivity, or a magnetic metal material or a non-magnetic metal lower in electrical conductivity than aluminum. The buoyancy reducing plate is disposed between the top plate and the heating coil; the plate is configured to alleviate the buoyancy effecting to a pot made of the high electrical conductivity material during induction heating. The infrared sensor detects the infrared radiation from the pot. The temperature calculator calculates a temperature of the pot based on an output from infrared sensor. The controller controls an output from the inverter circuit according to a temperature calculated by the temperature calculator, when the placed pot is judged to be made of a magnetic metal material or a non-magnetic metal lower in electrical conductivity than aluminum. When the pot type discriminator judges that the pot is made of a non-magnetic metal material having the high electrical conductivity, the controller nullifies a temperature detection made by the temperature calculator. Thereby, erroneous temperature detection caused by a self-generated heat at the buoyancy reducing plate reaching incidentally to the infrared sensor is prevented. The insufficiency of heating power due to the temperature control with an infrared sensor can be alleviated. Therefore, it enables a quick-responding cooking with the infrared sensor when heating a pot made of a magnetic material or a non-magnetic metal having a low electrical conductivity; when heating a pot made of a non-magnetic metal having the high electrical conductivity, the erroneous temperature detection due to the infrared radiation from the buoyancy reducing plate can be lowered. The overall cooking performance is thus improved.

BRIEF DESCRIPTION OF THE DRAWINGS

FIG. 5 is a cross sectional view showing the outline structure of a conventional induction heating cooker.

DETAILED DESCRIPTION OF PREFERRED EMBODIMENTS

Figure 1:
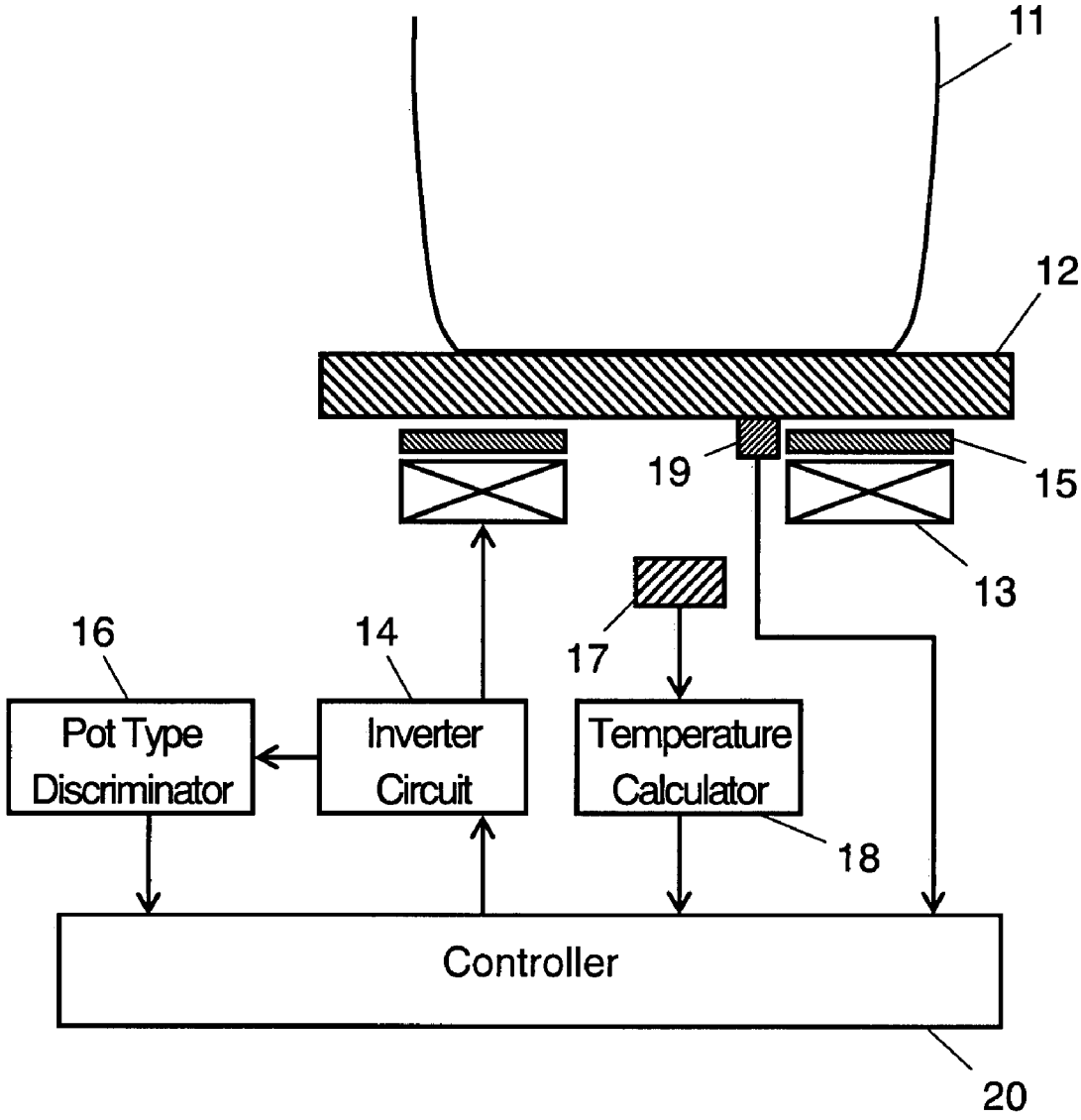
FIG. 1 is a cross sectional view of an induction heating cooker in accordance with a first exemplary embodiment of the present invention, used to show the concept of structure.

Exemplary embodiments of the present invention are described in the following referring to the drawings. It is to be noted that the embodiments shall not be interpreted as limiting the scope of the present invention.

First Exemplary Embodiment

Figure 2:
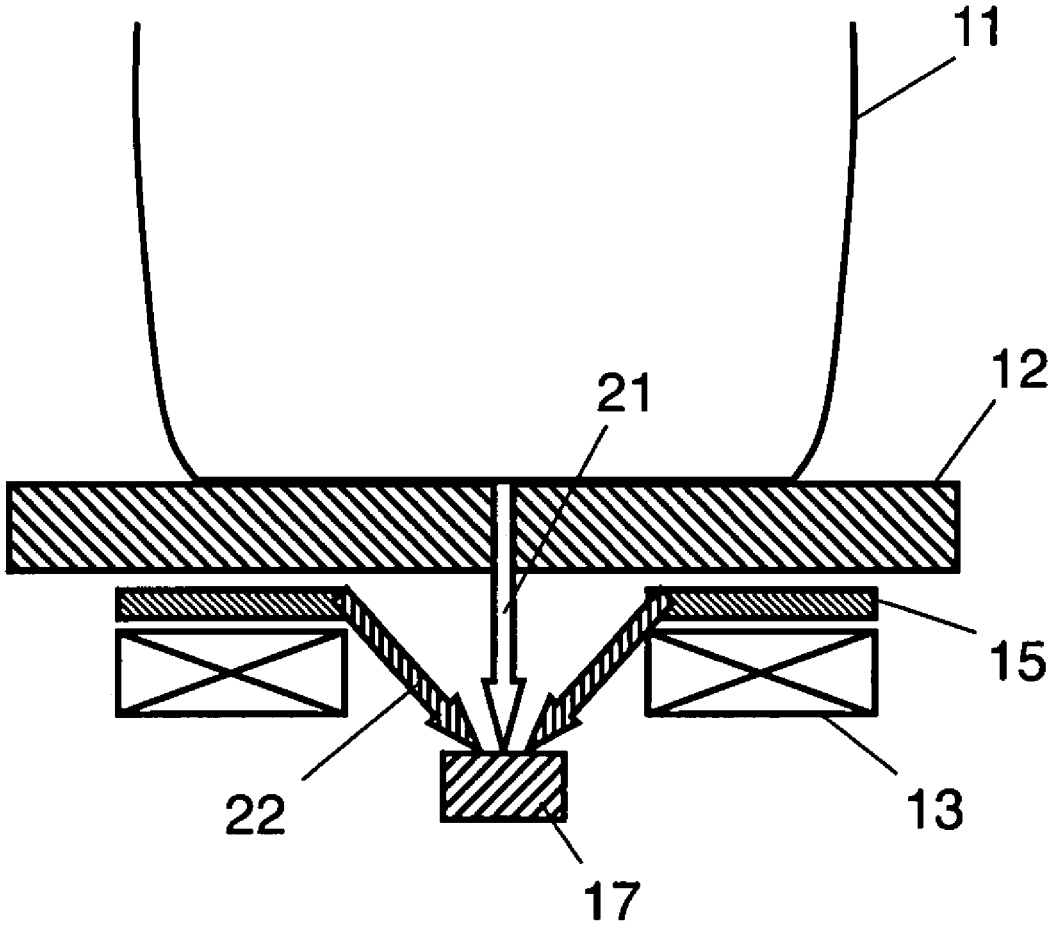
FIG. 2 is a cross sectional view of the cooker shown in FIG. 1, showing infrared radiations from a cooking pot and a buoyancy reducing plate.

FIG. 1 is a cross sectional view of an induction heating cooker in accordance with a first embodiment of the present invention, which shows the concept of structure. FIG. 2 is a cross sectional view which shows infrared radiations from pot 11 and buoyancy reducing plate 15. Top plate 12 places pot 11 thereon. Heating coil (hereinafter referred as "coil") 13 is disposed underneath top plate 12 and heats pot 11 by means of induction heating. Inverter circuit 14 supplies a high frequency current higher than 20 kHz to coil 13. Buoyancy reducing plate 15 is made of aluminum, copper or the like non-magnetic metal having a high electrical conductivity comparable to or higher than that of aluminum, and is disposed between top plate 12 and coil 13. The buoyancy reducing plate alleviates the buoyancy which works to a current induced in pot 11 by magnetic flux generated by coil 13 during an induction-heating of pot 11. Describing practically, buoyancy reducing plate 15 reduces a floating force effective to pot 11.

Pot type discriminator (hereinafter referred as "discriminator") 16 judges whether pot 11 is made of a magnetic metal material such as iron, cast iron, a magnetic stainless steel, etc., a non-magnetic metal lower in electrical conductivity than aluminum such as a non-magnetic stainless steel, etc. or a non-magnetic metal material having the high electric conductivity such as aluminum in accordance with an output from inverter circuit 14. Infrared sensor 17 detects an infrared radiation from pot 11. A thermopile, a pyroelectric infrared sensor and the like thermo-type infrared sensor, or a photodiode, a photo-transistor and the like quantum-type infrared sensor may be used as infrared sensor 17. Although there is no specific limitation to a type of the sensors, preference is on the speed of quick response and the compactness in size. Temperature calculator 18 calculates a temperature at the bottom of pot 11 from an output from infrared sensor 17.

First temperature sensor 19 is formed of a thermistor, which detects a temperature of pot 11 at the bottom taking advantage of the heat conduction via top plate 12. Controller 20 controls an output from inverter circuit 14 in accordance with outputs from discriminator 16, temperature calculator 18 and first temperature sensor 19. Discriminator 16, temperature calculator 18 and controller 20 are formed of microcomputer devices, etc.; they can be provided either individually or integrated into a single unit.

Now in the following, the operation of the above-configured induction heating cooker is described. When coil 13 is supplied with a high frequency current, pot 11 placed above coil 13 is heated. Pot 11 generates infrared radiation from the bottom corresponding to the bottom temperature. As shown in FIG. 2, infrared radiation 21 generated from pot 11 transmits top plate 12 and reaches infrared sensor 17. Also reaching infrared sensor 17 is infrared radiation 22 that is coming from buoyancy reducing plate 15. Besides reaching infrared sensor 17 directly as shown in FIG. 2, infrared radiation 22 from buoyancy reducing plate 15 reaches sensor 17 after being reflected by top plate 12, although the way is not illustrated. Temperature calculator 18 calculates the temperature of pot 11 based on input signal delivered from infrared sensor 17. Upon receiving the temperature information, controller 20 controls the current to coil 13 so as to provide a specified heating state.

Discriminator 16 makes judgment on a type of pot 11 by taking advantage of an output from inverter circuit 14 during supplying a high frequency current to coil 13. For example, discriminator 16 judges a type of pot 11 by comparing an input current from inverter 14 with a voltage generated at coil 13. Describing more practically, at the starting stage of heating it supplies a low output current to coil 13, and judges a type of pot 11 while gradually increasing the output current. As to the means of gradually increasing the output, one may use either a method of changing the frequency or a method in which the drive time ratio is changed using a two-device half bridge system with a frequency fixed.

If pot 11 is judged to be made of a magnetic metal material or a non-magnetic material having a low electrical conductivity by discriminator 16 at the early stage of judging operation when the output from inverter circuit 14 is small, controller 20 delivers a high frequency current of approximately 20 kHz to coil 13, and increases the current to coil 13 up to a target heating output. Pot 11 in this case is made of, for example, a magnetic metal material of iron group (iron, cast iron), a magnetic stainless steel, etc., or a non-magnetic metal lower in electrical conductivity than aluminum, viz. a non-magnetic stainless steel. A pot made of a non-magnetic stainless steel exhibits a small magnetic permeability, and the high frequency current permeates deeply into the bottom of pot 11. As a result, it is difficult to obtain a heating effect due to the skin surface effects. The non-magnetic stainless steel, however, is provided with a greater resistivity as compared with aluminum and copper, so that it can generate a heat of a certain specified amount with a smaller heating coil current.

When keeping heating a pot made of a magnetic metal material or a non-magnetic metal material having low electrical conductivity after reaching a target heating output, aluminum-made buoyancy reducing plate 15 hardly makes self heat generation due to magnetic flux of coil 13, because the current flow in coil 13 has a low frequency and relatively small. Therefore, infrared radiation 22 from buoyancy reducing plate 15 hardly ill-affects the operation of sensing infrared radiation 21 coming from pot 11. So, controller 20 controls the output from inverter circuit 14 based on results of temperature detection made by temperature calculator 18 and first temperature sensor 19 when at least either one of the detected temperatures satisfies respective predetermined requirements. For example, when a detected temperature exceeded a predetermined level, or the inclination of detected temperature goes beyond a predetermined value, controller 20 controls the output from inverter circuit 14. Namely, controller 20 makes the temperature or the temperature inclination of pot 11 to be lower than a predetermined value by suppressing the high frequency current to coil 13, or by interrupting the heating operation.

On the other hand, if discriminator 16 judges that pot 11 is made of a non-magnetic metal material having the high electric conductivity, controller 20 supplies a high frequency current of approximately 60 kHz to coil 13. Pot 11 in this case is made of a non-magnetic metal material, such as aluminum, copper, etc., for example.

When heating a pot made of a non-magnetic metal material having a low magnetic permeability and a low resistance, e.g. aluminum, copper, it is required to increase the amount of magnetic flux by providing coil 13 with a current of higher frequency for a substantial amount as compared with a case where a pot made of a magnetic metal material is used. Consequently, the self heat generation of buoyancy reducing plate 15 increases either. Buoyancy reducing plate 15 is made of a non-magnetic metal material having the high electrical conductivity because of the need for suppressing the heat generation caused by magnetic flux from coil 13. However, in the case where pot 11 is made of a non-magnetic metal material having the high electrical conductivity, the temperature of buoyancy reducing plate 15 may sometimes rise to as high as 300-400° C. Influenced by the infrared radiation from buoyancy reducing plate 15, infrared sensor 17 may erroneously report a temperature that is far higher than the real temperature of pot 11. Therefore, controller 20 disregards the detection results of temperature calculator 18, and controls an output from inverter circuit 14 in accordance with the result of the detection made by first temperature sensor 19 so that the temperature of pot 11 becomes lower than a predetermined level or to be lower than a predetermined temperature inclination.

Even if discriminator 16 judges that a pot is made of a non-magnetic metal material having the high electrical conductivity, temperature of buoyancy reducing plate 15 does not rise to as high as the above-described level when the heating power is low. Therefore, infrared radiation 22 from buoyancy reducing plate 15 does not give a material influence on the temperature detection performed by infrared sensor 77. Under such a power setting, the temperature detection with infrared sensor 17 is not ill-affected if a non-magnetic metal pot is used. In this case, controller 20 controls the output from inverter circuit 14 based on detection results coming from temperature calculation unit 18 and first temperature sensor 19 so that the temperature of pot 11 becomes lower than a predetermined temperature or to be lower than a predetermined temperature inclination.

As described in the above, an induction heating cooker in the present embodiment nullifies the result of temperature detection made by infrared sensor 17 when discriminator 16 judges that pot 11 is made of a non-magnetic metal material. Thus, in a case where pot 11 is made of a magnetic material or a non-magnetic metal material having a low electrical conductivity, the quick-responding temperature control with infrared sensor 17 can be employed, whereas in other case where pot 11 is made of a non-magnetic metal material having the high electrical conductivity, a possible error in temperature detection with infrared sensor 17 due to self heat generation of buoyancy reducing plate 15 can be alleviated. Even in a case of heating a pot of non-magnetic metal material having the high electrical conductivity, temperature detection with infrared sensor 17 is kept valid if the power setting is lower than a certain specific level. Thus, the quick-responding temperature control with infrared sensor 17 can be adopted regardless of the material of pot 11 in so far as the power state is within a range where the temperature detection with infrared sensor 17 is not ill-affected by infrared radiation 22 coming from buoyancy reducing plate 15.

Figure 3:
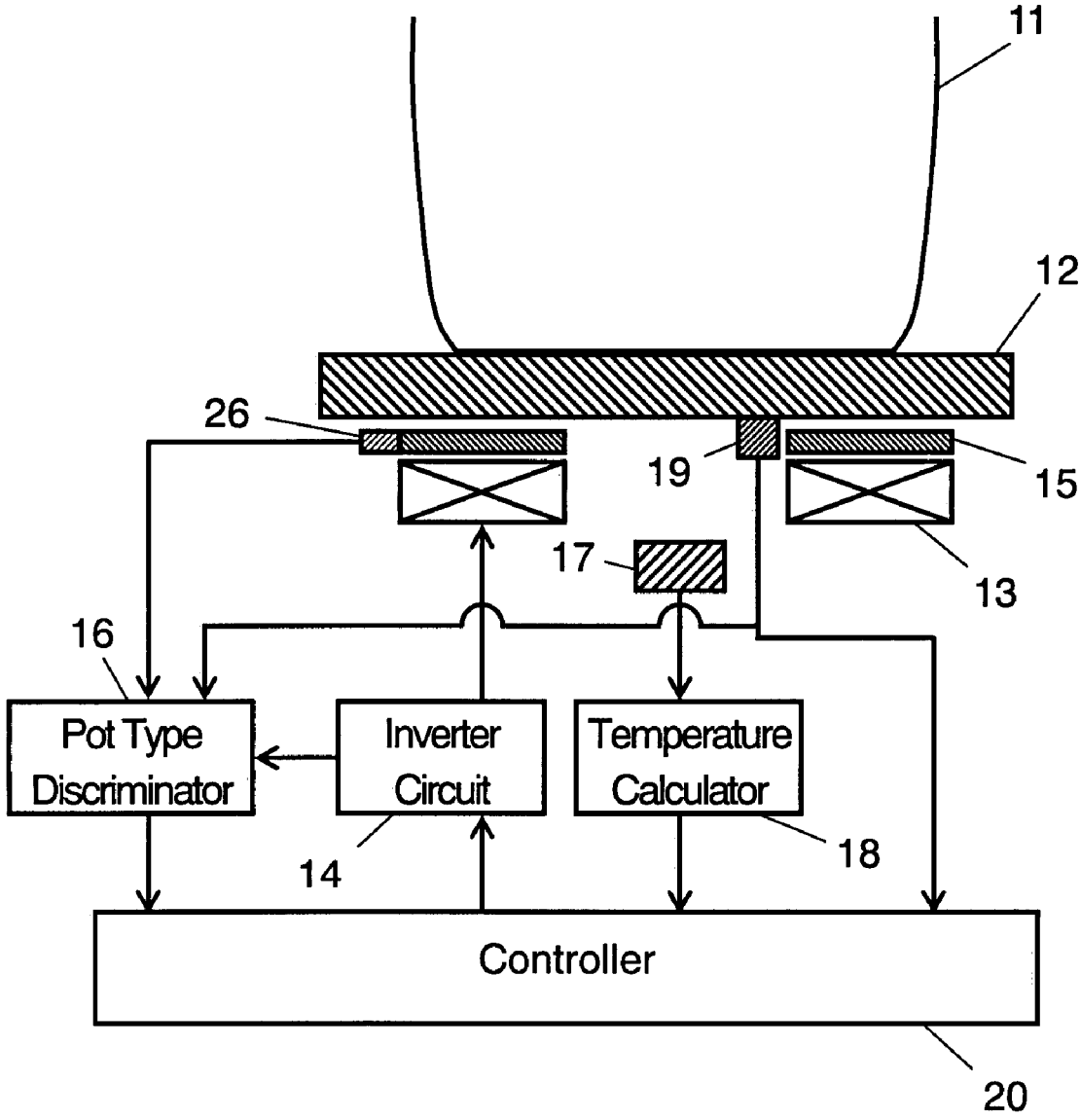
FIG. 3 is a cross sectional view of another induction heating cooker in the first embodiment, used to show the concept of structure.

The configuration of discriminator 16 is not limited to the one as described in the above. It may be formed, for example, as illustrated in FIG. 3. In the configuration, second temperature sensor 26, a thermistor, is provided for measuring a temperature or the temperature inclination of buoyancy reducing plate 15, thereby judging a type of pot 11. If second temperature sensor 26 exhibits a certain specific temperature value (a second temperature that is higher than first temperature) or if a change in the measured temperature by second temperature sensor 26 exceeds a certain limit despite a measured temperature by first temperature sensor 19 is lower than a certain specific value (first temperature), discriminator 16 can judge that pot 11 is made of a non-magnetic metal material having the high electrical conductivity. The first temperature here is set at, for example, 100° C., while the second temperature at 200° C. A possible judgment error due to a delayed rising of the first temperature can be prevented by setting the second temperature to be somewhat higher than the first temperature. When discriminator 16 judges as described in the above, controller 20 disregards a result of detection by temperature calculator 18 and controls an output from inverter circuit 14 so that temperature of pot 11 becomes to be lower than a certain specific temperature. Controller 20 can determine the conditions more precisely for putting infrared sensor 17 into operation, when discriminator 16 makes its judgment taking both the output from second temperature sensor 26 (FIG. 3) and the output from inverter circuit 14 (FIG. 1) into consideration.

Second Exemplary Embodiment

Figure 4:
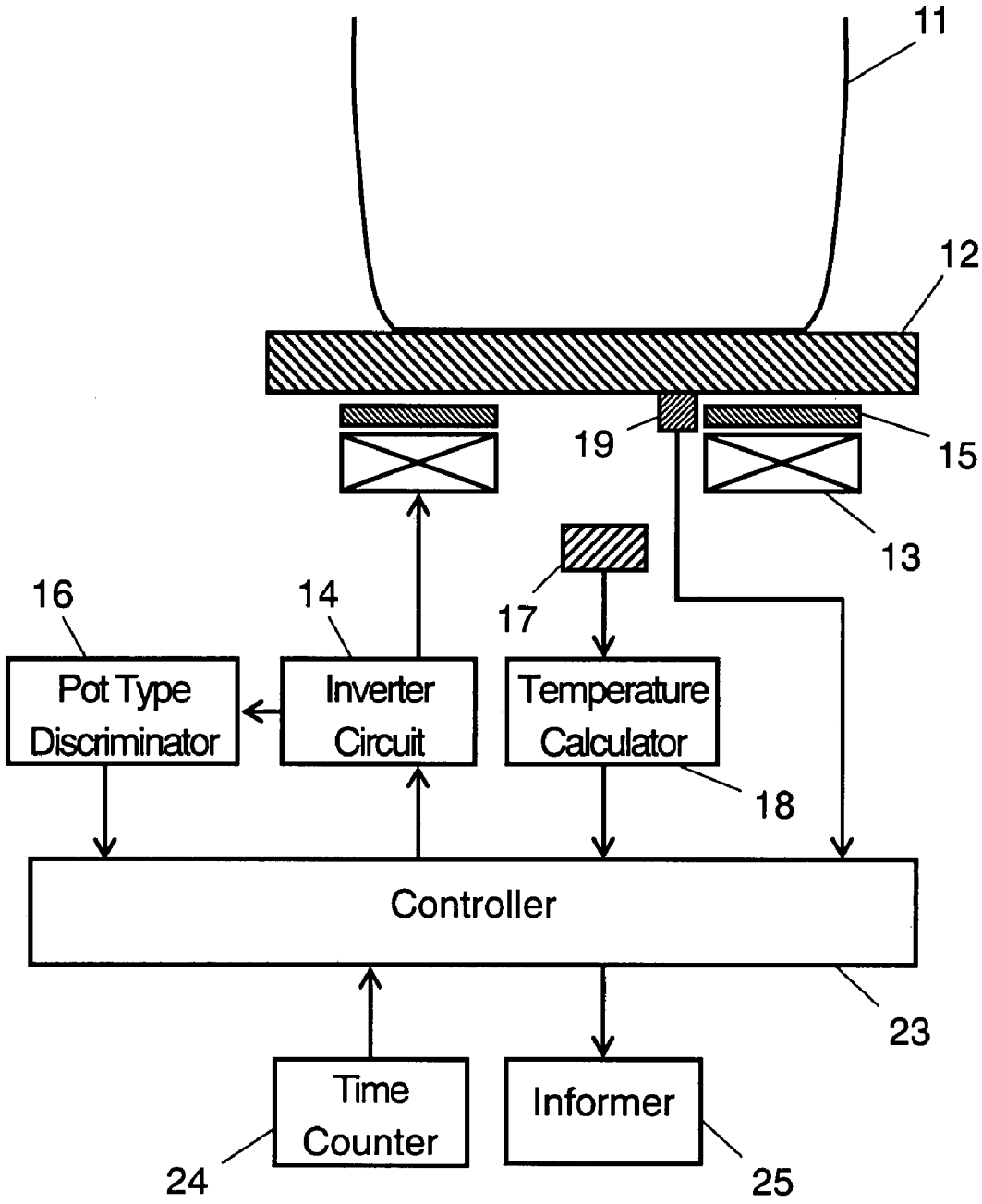
FIG. 4 is a cross sectional view of an induction heating cooker in accordance with a second exemplary embodiment, used to show the concept of structure.

FIG. 4 is a cross sectional view showing the structural outline of an induction heating cooker in accordance with a second embodiment of the present invention. Those portions identical to those of the first embodiment are designated with the same symbols, and detailed description thereon is eliminated. The point of difference as compared with the first embodiment is that controller 23 is provided in place of controller 20, and time counter 24 and informer 25 is provided additionally.

Controller 23 configured to control an automatic cooking scheme, controls an output from inverter circuit 14 based on the outputs from discriminator 16, temperature calculator 18 and first temperature sensor 19 in accordance with a certain specific algorithm. Time counter 24 counts the time of heating a pot which is made of a non-magnetic metal material having the high electrical conductivity in a state that the pot is recognized by discriminator 16 to be made of such a material. Informer 25 notifies that an automatic cooking scheme is being prohibited by controller 23. Controller 23 is formed of microcomputer devices, memory devices, etc. Time counter 24 is formed of a microcomputer, a timer, etc. Informer 25 is formed of an LCD panel or the like display device and/or an audio output device such as a speaker, a buzzer, etc. The following description will be made on an example where a display device is used for the informer.

The operation of the above-configured induction heating cooker is described below. Temperature calculator 18 calculates a temperature of pot 11 or the temperature inclination based on an input signal delivered from infrared sensor 17, while controller 23 controls a current flow in coil 13 based on a signal from temperature calculator 18 and a certain specific algorithm that corresponds to a certain designated automatic cooking menu.

In a case where pot 11 is made of a non-magnetic metal material having the high electrical conductivity such as aluminum, copper, etc., the temperature of buoyancy reducing plate 15 may sometimes rise to as high as 300-400° C. In such an occasion, infrared sensor 17 is influenced by infrared radiation 22 coming from buoyancy reducing plate 15 as shown in FIG. 2, and the sensor erroneously recognizes a far higher temperature as the temperature of pot 11. Or, the cooker might fail to detect a critical point in the course of temperature shift, that is, the boiling point during heating of water, the finishing point of heating during rice cooking, the ready point in deep fry cooking, etc. The failure would lead to such inconveniences as the insufficiency of heating power, the boiling over or scorching, etc due to delayed detection. In order to prevent such inconveniences to happen, controller 23 banns an automatic cooking scheme when discriminator 16 judges the placed pot to be made of a non-magnetic metal material having the high electrical conductivity. It is preferable to notify the situation by informer 25.

Even in a case where an automatic cooking scheme is introduced for heating pot 11 which is made of a magnetic metal material of iron group or a non-magnetic metal material of low electrical conductivity immediately after finishing a heating of a pot made of a non-magnetic metal material having the high electrical conductivity, there remains a risk of erroneous temperature detection. The erroneous temperature detection at temperature calculator 18 is caused by infrared radiation 22 coming from buoyancy reducing plate 15 whose temperature is raised by a self heat generation during heating of the non-magnetic metal material having the high electrical conductivity. In order to prevent this to happen, it is preferable that controller 23 blocks the starting of a new subsequent automatic cooking scheme for a certain specific time after a program for heating a pot judged by discriminator 16 to be made of a non-magnetic metal material having the high electrical conductivity, has been finished, or for a certain time counted by time counter 24. By so doing, an automatic cooking scheme for a pot made of a magnetic metal material or a non-magnetic metal material of low electrical conductivity can be introduced after the cooker has been used for heating a pot of non-magnetic metal material having the high electrical conductivity, without the risk of being influenced by a remaining heat generated from buoyancy reducing plate 15 whose temperature is raised when heating a pot made of a non-magnetic metal material having the high electrical conductivity. It is preferable that the above-described status is displayed on informer 25.

As described above, an induction heating cooker in the present embodiment blocks an automatic cooking scheme if pot 11 is judged to be made of a non-magnetic metal material having the high electrical conductivity by discriminator 16. So, when heating pot 11 is made of a magnetic metal material or a non-magnetic metal material of low electrical conductivity, the quick-responding automatic cooking scheme with infrared sensor 17 can be used. When heating pot 11 is made of a non-magnetic metal material having the high electrical conductivity, the cooker prevents a possible failure of an automatic cooking scheme due to an erroneous temperature detection by infrared sensor 17 caused by the self heat generation of buoyancy reducing plate 15.

When using an automatic cooking scheme after a pot made of a non-magnetic metal material having the high electrical conductivity has been heated, the present cooker can perform the automatic cooking scheme without the infrared sensor 17 being influenced by a remaining heat in buoyancy reducing plate 15 that has been heated during heating of the pot made of a non-magnetic metal material having the high electrical conductivity.

It is preferable that the blocking time before the start of a following automatic cooking scheme is adjustable in accordance with a length of time used for heating a pot made of a non-magnetic metal material having the high electrical conductivity prior to the automatic cooking. If the time used for heating the pot of non-magnetic metal material having the high electrical conductivity is short and a temperature rise at buoyancy reducing plate 15 is small, a waiting time before the automatic cooking can be made to be the shortest possibly. Thus the present induction heating cooker can improve the convenience of automatic cooking scheme without sacrificing the total quality of cooking performance.

In addition, as the blocked state of automatic cooking is notified visually, or by audio means at informer 25, users can easily recognize the blocked state of his or her induction heating cooker.

Same as in the first embodiment, when the cooking power is low, the temperature of buoyancy reducing plate 15 does not rise up to as high as 300-400° C. even if a pot made of a non-magnetic metal material having the high electrical conductivity is heated. Accordingly, infrared radiation 22 from buoyancy reducing plate 15 is not so substantial as to giving influence to the temperature sensing operation of infrared sensor 17. Therefore, it is preferable that controller 23 limits the greatest cooking power to be lower than a certain level under which it does not ill-affect the temperature sensing by infrared sensor 17, when discriminator 16 judges a pot to be made of a non-magnetic metal material having the high electrical conductivity. And then, it is preferable that controller 23 controls the current flow in coil 13 based on a signal from temperature calculator 18 and an algorithm that corresponds to a designated automatic cooking menu.

As described above, also when heating a pot made of a non-magnetic metal material having the high electrical conductivity, controller 23 in the present embodiment limits the greatest output power to the pot which is made of a non-magnetic metal material having the high electrical conductivity to be lower than a certain specific value. Thus, it enables to introduce an automatic cooking scheme utilizing the quick-responding infrared sensor 17 also when heating a pot made of a non-magnetic metal material having the high electrical conductivity.

Although first temperature sensor 19 is described as a constituent member in the first and the second embodiments, the sensor can be eliminated if an output from inverter circuit 14 stays to be lower than a certain specific level of cooking power, and the identical advantages can be provided. In such a case, controller 20, 23 controls inverter circuit 14 in accordance with a temperature calculated at temperature calculator 18. Thus, it enables a high precision temperature control which always makes full use of infrared sensor 17, regardless of a kind of pot 11 that is the object of heating.

Informer 25 may be provided also in the first embodiment. When a temperature detected at temperature calculator 18 is being nullified, such a state of nullification may be displayed in the informer. Then, users can see whether pot 11 is made of a magnetic metal material, a non-magnetic metal material having low electrical conductivity, or a non-magnetic metal material having the high electrical conductivity. If a material of pot 11 is seen to be erroneously detected, they can judge that the induction heating cooker is out of order.

INDUSTRIAL APPLICABILITY

An induction heating cooker in the present invention enables to heat a cooking pot that is made of aluminum or the like non-magnetic metal material having the high electrical conductivity. When heating the pot made of a non-magnetic metal having the high electrical conductivity, the temperature detection made by an infrared sensor is nullified in order to avoid a possible influence of infrared radiation from the buoyancy reducing plate, which is made of a non-magnetic metal of a high electrical conductivity, to the infrared sensor. The above control enables to employ a high precision temperature control making full use the quick-responding infrared sensor, when heating a magnetic metal pot. Meanwhile, the present induction heating cooker provides an improved cooking performance also when heating a pot made of a non-magnetic metal material having the high electrical conductivity, without a risk of insufficient cooking power due to an erroneous temperature detection made by infrared sensor.

The invention claimed is:

1. An induction heating cooker comprising:

a top plate configured to place a cooking pot thereon, a heating coil disposed underneath the top plate, an inverter circuit configured to supply a high frequency current to the heating coil, a pot type discriminator configured to judge whether the cooking pot is made of a non-magnetic metal material having a high electrical conductivity comparable to or higher than that of aluminum, or a magnetic metal material or a non-magnetic metal lower in electrical conductivity than aluminum, a buoyancy reducing plate made of a non-magnetic metal having a high electrical conductivity comparable to or higher than that of aluminum, the buoyancy reducing plate being disposed between the top plate and the heating coil and being configured to reduce a buoyancy effective to the cooking pot during induction-heating the cooking pot, an infrared sensor configured to detect an infrared radiation, the infrared radiation being radiated from the cooking pot and going through the top plate, a temperature calculator configured to calculate a temperature of the cooking pot from an output of the infrared sensor, and a controller configured to control an output of the inverter circuit in accordance with a temperature calculated by the temperature calculator, and to nullify a temperature calculation made by the temperature calculator when the pot type discriminator judges that the cooking pot is made of a non-magnetic metal material having a high electrical conductivity comparable to or higher than that of aluminum.

2. The induction heating cooker according to claim 1, further comprising a first temperature sensor configured to measure a temperature of the cooking pot by a heat conduction via the top plate.

3. The induction heating cooker according to claim 2, wherein, the controller suppresses high frequency current to be supplied to the heating coil or interrupts a heating operation when at least either one of a temperature calculated at the temperature calculator and a temperature detected at the first temperature sensor satisfies respective predetermined conditions.

4. The induction heating cooker according to claim 2 further comprising a second temperature sensor configured to measure a temperature of the buoyancy reducing plate, wherein, the pot type discriminator judges that the cooking pot is made of a non-magnetic metal material having a high electrical conductivity comparable to or higher than that of aluminum when a temperature measured at the first temperature sensor is lower than a first temperature and a temperature measured at the second temperature sensor is higher than a second temperature that is higher than the first temperature.

5. The induction heating cooker according to claim 1 further comprising a second temperature sensor configured to measure a temperature of the buoyancy reducing plate, wherein the pot type discriminator judges that the cooking pot is made of a non-magnetic metal material having a high electrical conductivity comparable to or higher than that of aluminum when a change of temperature measured at the second temperature sensor is greater than a certain specific value.

6. The induction heating cooker according to claim 1, wherein the pot type discriminator judges based on an output from the inverter circuit whether the cooking pot is made of a non-magnetic metal material having a high electrical conductivity comparable to or higher than that of aluminum, or a magnetic metal material or a non-magnetic metal material lower in electrical conductivity than aluminum.

7. The induction heating cooker according to claim 1, wherein in a case where the pot type discriminator judges that the cooking pot is made of a non-magnetic metal material having a high electrical conductivity comparable to or higher than that of aluminum and an output from the inverter circuit is lower than a certain specific value, the controller stops nullifying the temperature detection made by the temperature calculator, and controls the inverter circuit in accordance with the temperature calculated at the temperature calculator.

8. The induction heating cooker according to claim 1, further comprising an informer configured to exhibit a nullified status when the controller is nullifying the temperature detected by the temperature calculator.

9. The induction heating cooker according to claim 1, wherein the controller performs an automatic cooking by controlling an output from the inverter circuit based on a temperature calculated at the temperature calculator in accordance with a certain specific algorithm.

10. The induction heating cooker according to claim 9, wherein the controller blocks an automatic cooking scheme when the pot type discriminator judges that the cooking pot is made of a non-magnetic metal material having a high electrical conductivity comparable to or higher than that of aluminum.

11. The induction heating cooker according to claim 10, further comprising an informer configured to exhibit that the controller is blocking the automatic cooking scheme when the controller is blocking an automatic cooking scheme.

12. The induction heating cooker according to claim 9, wherein when the pot type discriminator judges that the cooking pot is made of a non-magnetic metal material having a high electrical conductivity comparable to or higher than that of aluminum, the controller limits a greatest output of the inverter circuit to be lower than a certain specific value.

13. The induction heating cooker according to claim 9, wherein the controller blocks starting of an automatic cooking scheme for a certain specific time after heating of a cooking pot made of a non-magnetic metal material having a high electrical conductivity comparable to or higher than that of aluminum is finished.

14. The induction heating cooker according to claim 13, further comprising a time counter configured to count a time of heating a cooking pot while the pot type discriminator is judging that the cooking pot is made of a non-magnetic metal material having a high electrical conductivity comparable to or higher than that of aluminum, wherein the controller changes a blocking time before starting of a forthcoming automatic cooking scheme in accordance with a time counted at the time counter.

15. The induction heating cooker according to claim 13, further comprising a informer configured to exhibit that the controller is blocking an automatic cooking scheme when the controller is blocking an automatic cooking scheme.

16. An induction heating cooker comprising:

a top plate configured to place a cooking pot thereon, a heating coil disposed underneath the top plate, an inverter circuit configured to supply a high frequency current to the heating coil, a pot type discriminator configured to judge whether the cooking pot is made of a non-magnetic metal material having a high electrical conductivity comparable to or higher than that of aluminum, or a magnetic metal material or a non-magnetic metal lower in electrical conductivity than aluminum, a buoyancy reducing plate made of a non-magnetic metal having a high electrical conductivity comparable to or higher than that of aluminum, the buoyancy reducing plate being disposed between the top plate and the heating coil and being configured to reduce a buoyancy effective to the cooking pot during induction-heating the cooking pot, an infrared sensor configured to detect an infrared radiation from the cooking pot, a temperature calculator configured to calculate a temperature of the cooking pot from an output of the infrared sensor, a controller configured to control an output of the inverter circuit in accordance with a temperature calculated by the temperature calculator, and to nullify a temperature calculation made by the temperature calculator when the pot type discriminator judges that the cooking pot is made of a non-magnetic metal material having a high electrical conductivity comparable to or higher than that of aluminum, a first temperature sensor configured to measure a temperature of the cooking pot by a heat conduction via the top plate, and a second temperature sensor configured to measure a temperature of the buoyancy reducing plate, wherein, the pot type discriminator judges that the cooking pot is made of a non-magnetic metal material having a high electrical conductivity comparable to or higher than that of aluminum when a temperature measured at the first temperature sensor is lower than a first temperature and a temperature measured at the second temperature sensor is higher than a second temperature that is higher than the first temperature.

17. An induction heating cooker comprising:

a top plate configured to place a cooking pot thereon, a heating coil disposed underneath the top plate, an inverter circuit configured to supply a high frequency current to the heating coil, a pot type discriminator configured to judge whether the cooking pot is made of a non-magnetic metal material having a high electrical conductivity comparable to or higher than that of aluminum, or a magnetic metal material or a non-magnetic metal lower in electrical conductivity than aluminum, a buoyancy reducing plate made of a non-magnetic metal having a high electrical conductivity comparable to or higher than that of aluminum, the buoyancy reducing plate being disposed between the top plate and the heating coil and being configured to reduce a buoyancy effective to the cooking pot during induction-heating the cooking pot, an infrared sensor configured to detect an infrared radiation from the cooking pot, a temperature calculator configured to calculate a temperature of the cooking pot from an output of the infrared sensor, a controller configured to control an output of the inverter circuit in accordance with a temperature calculated by the temperature calculator, and to nullify a temperature calculation made by the temperature calculator when the pot type discriminator judges that the cooking pot is made of a non-magnetic metal material having a high electrical conductivity comparable to or higher than that of aluminum, and a temperature sensor configured to measure a temperature of the buoyancy reducing plate, wherein, the pot type discriminator judges that the cooking pot is made of a non-magnetic metal material having a high electrical conductivity comparable to or higher than that of aluminum when a change of temperature measured at the temperature sensor is greater than a certain specific value.

18. An induction heating cooker comprising:

a top plate configured to place a cooking pot thereon, a heating coil disposed underneath the top plate, an inverter circuit configured to supply a high frequency current to the heating coil, a pot type discriminator configured to judge whether the cooking pot is made of a non-magnetic metal material having a high electrical conductivity comparable to or higher than that of aluminum, or a magnetic metal material or a non-magnetic metal lower in electrical conductivity than aluminum, a buoyancy reducing plate made of a non-magnetic metal having a high electrical conductivity comparable to or higher than that of aluminum, the buoyancy reducing plate being disposed between the top plate and the heating coil and being configured to reduce a buoyancy effective to the cooking pot during induction-heating the cooking pot, an infrared sensor configured to detect an infrared radiation from the cooking pot, a temperature calculator configured to calculate a temperature of the cooking pot from an output of the infrared sensor, a controller configured to control an output of the inverter circuit in accordance with a temperature calculated by the temperature calculator, and to nullify a temperature calculation made by the temperature calculator when the pot type discriminator judges that the cooking pot is made of a non-magnetic metal material having a high electrical conductivity comparable to or higher than that of aluminum, and a time counter configured to count a time of heating a cooking pot while the pot type discriminator is judging that the cooking pot is made of a non-magnetic metal material having a high electrical conductivity comparable to or higher than that of aluminum, wherein the controller performs an automatic cooking by controlling an output from the inverter circuit based on a temperature calculated at the temperature calculator in accordance with a certain specific algorithm, the controller blocks starting of an automatic cooking scheme for a certain specific time after heating of a cooking pot made of a non-magnetic metal material having a high electrical conductivity comparable to or higher than that of aluminum is finished, and the controller changes a blocking time before starting of a forthcoming automatic cooking scheme in accordance with a time counted at the time counter.

* * * * *